US010669898B2

(12) United States Patent
Aumann et al.

(10) Patent No.: US 10,669,898 B2
(45) Date of Patent: Jun. 2, 2020

(54) CONTROL OF ORC PROCESSES BY INJECTING UNEVAPORATED FLUID

(71) Applicant: ORCAN ENERGY AG, Munich (DE)

(72) Inventors: Richard Aumann, Munich (DE); Roy Langer, Munich (DE); Fabian Kricke, Munich (DE); Andreas Schuster, Tussenhausen (DE)

(73) Assignee: ORCAN ENERGY AG, München (DE)

( * ) Notice: Subject to any disclaimer, the term of this patent is extended or adjusted under 35 U.S.C. 154(b) by 59 days.

(21) Appl. No.: 15/745,420

(22) PCT Filed: Jun. 13, 2016

(86) PCT No.: PCT/EP2016/063449
§ 371 (c)(1),
(2) Date: Jan. 16, 2018

(87) PCT Pub. No.: WO2017/008972
PCT Pub. Date: Jan. 19, 2017

(65) Prior Publication Data

US 2018/0209307 A1 Jul. 26, 2018

(30) Foreign Application Priority Data

Jul. 16, 2015 (EP) ..... 15177121

(51) Int. Cl.
*F01K 23/14* (2006.01)
*F01K 7/02* (2006.01)
(Continued)

(52) U.S. Cl.
CPC ..... *F01K 23/14* (2013.01); *F01K 7/025* (2013.01); *F01K 7/04* (2013.01); *F01K 25/06* (2013.01)

(58) Field of Classification Search
CPC ... F01K 7/04; F01K 7/025; F01K 7/06; F01K 7/08; F01K 7/18; F01K 7/20; F01K 7/226; F01K 23/065; F01K 25/08
(Continued)

(56) References Cited

U.S. PATENT DOCUMENTS 3,234,734 A 2/1966 Buss et al.
5,555,731 A 9/1996 Rosenblatt
(Continued)

FOREIGN PATENT DOCUMENTS

WO WO-2014117159 A1 * 7/2014 ..... F01D 13/003

OTHER PUBLICATIONS

International Search Report for International Patent Application No. PCT/EP2016/063449 dated Sep. 8, 2016.
(Continued)

*Primary Examiner* — Mark A Laurenzi
*Assistant Examiner* — Mickey H France
(74) *Attorney, Agent, or Firm* — Moore & Van Allen, PLLC; Henry B. Ward, III

(57) ABSTRACT

The invention relates to a thermodynamic cycle device, in particular an ORC device, comprising a preheater for preheating a working medium; an evaporator for evaporating and superheating a first mass flow of the preheated working medium; an expansion machine for expanding the evaporated and superheated first mass flow of the working medium; a condenser for condensing the working medium exiting the expansion machine; a feed pump for pumping condensed working medium to the preheater; and a first supply apparatus for supplying a second mass flow of the preheated working medium to the partially expanded first mass flow of the working medium in the expansion machine. The invention further relates to a corresponding method.

20 Claims, 5 Drawing Sheets

(51) Int. Cl.
*F01K 7/04* (2006.01)
*F01K 25/06* (2006.01)

(58) Field of Classification Search
USPC ..... 60/614–620, 643, 645, 647, 651, 652, 60/653, 657, 658, 660, 662, 663, 666, 60/667, 668, 670, 671, 676, 677
See application file for complete search history.

(56) References Cited

U.S. PATENT DOCUMENTS

| | | | | |
|---|---|---|---|---|
| 6,035,643 | A | 3/2000 | Rosenblatt | |
| 2002/0007636 | A1* | 1/2002 | Hay | F01K 23/065 60/618 |
| 2012/0240575 | A1* | 9/2012 | Mori | F02G 5/00 60/616 |
| 2013/0140830 | A1* | 6/2013 | Hinks | F03G 7/04 290/1 R |
| 2016/0061055 | A1* | 3/2016 | Bowan | F01K 7/06 290/40 B |

OTHER PUBLICATIONS

Written Opinion for International Patent Application No. PCT/EP2016/063449 dated Sep. 8, 2016.
European Search Report for European Application No. 15177121 dated Jan. 13, 2016.
Indian Examination Report for corresponding Indian Patent Application No. 201847005331, dated Jul. 24, 2019, 6 pages.

* cited by examiner

CONTROL OF ORC PROCESSES BY INJECTING UNEVAPORATED FLUID

FIELD OF THE INVENTION

The invention relates to a thermodynamic cycle device, which can be in particular an ORC device, and comprises a preheater for preheating a working medium; an evaporator for evaporating and possibly superheating a first mass flow of the preheated working medium; an expansion machine for expanding the evaporated and superheated mass flow of the working medium; a condenser for condensing and optionally subcooling the working medium exiting at the outlet; and a feed pump for pumping condensed working fluid to the preheater. Furthermore, the invention relates to a corresponding method for operating a thermodynamic cycle, in particular an ORC process.

BACKGROUND OF THE INVENTION

When a power-generating process, such as the Organic Rankine Cycle (ORC), is operated in the environment of another equipment assembly, such as e.g. an internal combustion engine, both the direct integration of the generated energy as mechanical power into the external system (e.g., the expansion machine of the power-generating process can drive the external process at least in a supportive manner), as well as its provision for auxiliaries (e.g., the external process can drive a pump in the power-generating process) are often advantageous, since conversion losses arise when mechanical energy is converted into electrical energy. In addition, costs are also eliminated for the reasons that motors for the drive or generators for the output are omitted, and the compactness can be increased, both of which are critical factors for the integration of a power-generating process into said environment.

However, due to a direct connection (for example, a coupling via a rigid shaft), one of the processes loses the degree of freedom of rotational speed control (usually the downstream process). To avoid this, a connection via a transmission can be effected. As a result, both a stepped and a stepless connection can enable rotational speed control. However, this regain in rotational speed control is accompanied by a number of disadvantageous characteristics. On the one hand, a transmission represents an additional expense which, depending on the application, has considerable influence on the cost-effectiveness. This effect is increased by the fact that transmissions (in particular stepless ones) also lead to a loss of efficiency. Transmissions are also subject to considerable stress and therefore add additional maintenance and related costs to the system. Last but not least, a transmission also consumes a comparatively large amount of installation space, which is contrary to the aim of compactness in many applications of motor integration.

Due to the coupling of the expansion machine presently described or the coupling of both the expansion machine and the feed pump of the ORC system to external processes without a transmission, the degrees of freedom of rotational speed control are lost. As a result, it is not possible to control parameters that are favorable for the ORC operation and that are required for the components—in particular volume flows, temperatures and pressure levels. This poses a particular problem for operations, since the allowed temperatures of the components are limited, in particular on the flow-off side of the expansion machine.

Due to the absence of the rotational speed control of the expansion machine, an expansion ratio can not be selectively provided which correlates to the volume ratio fixedly installed in a volumetric expansion machine. The typical prior art implementation of a variable volume ratio by way of a variable inlet or outlet window represents a complex and expensive process which impairs the cost-effectiveness of ORC systems. However, an expansion which is unsuitable for the expansion machine can lead to greatly decreasing efficiency and therefore likewise to the overall system not being cost-effective, or in extreme cases can result in exceeding the maximum permissible pressure. Exceeding the maximum permissible pressures and temperatures results in the system failing with possible consequential damage.

BRIEF SUMMARY OF THE INVENTION

The object of the invention is to overcome, at least in part, the drawbacks mentioned, and accordingly to satisfy, at least in part, the following four objects:

1. Reducing superheating (at a given pressure) to protect the components from operating at temperatures above their limits and/or reducing superheating to ensure cost-effectiveness of the system through improved degrees of efficiency. Superheating with dry fluids per se is detrimental to the efficiency, as it represents energy at a high temperature level which does not contribute to the expansion. The further the exhaust steam is in the superheated range, the more heat must be dissipated in the condenser prior to liquefaction.
2. Avoiding volume ratios that are ineffective for operation due to the non-controllable pressure levels at a fixed volume ratio of the expansion machine.
3. Avoiding pressures that are too high (absolute or in relation to the evaporating temperature obtainable by the system), which can lead to system damage or non-evaporation of the fluid or parts thereof, which can also cause damage in addition to a loss of efficiency.
4. Avoiding excessive mass flows of the working medium which can not be evaporated (to a sufficient extent) by the available heat.

Objects 1 and 2 are satisfied by a device according to claim 1 and a method according to claim 11.

The thermodynamic cycle according to the invention, which can be in particular an ORC device, comprises a preheater for preheating a working medium; an evaporator for evaporating and superheating a first mass flow of the preheated working medium; an expansion machine for expanding the evaporated and superheated first mass flow of the working medium; a condenser for condensing the working medium exiting the expansion machine; and a feed pump for pumping condensed working fluid to the preheater. The thermodynamic cycle device according to the invention is characterized by a first supply apparatus for supplying a second mass flow of the preheated working medium to the partially expanded first mass flow of the working medium in the expansion machine.

This enables the degrees of freedom of lowering the exhaust steam temperature and of an adapted expansion ratio. Superheating can be reduced in this manner, and the volume ratio of the expansion can be reduced dynamically.

The device according to the invention can be further developed such that the first supply apparatus can comprise a supply inlet of the expansion machine and a first supply line between the preheater and the supply inlet.

The supply inlet can be disposed in fluid communication with an expansion space of the expansion machine at a predetermined volume region of the expansion space, where the expansion space expands between an inlet and an outlet of the expansion machine.

Another development is that the first supply apparatus comprises a first actuatable throttle element, in particular a first thermostatic expansion valve, for controlling the second mass flow and/or where the first supply apparatus can comprise an injection device at the expansion machine, in particular at the supply inlet.

According to a further development, the thermodynamic cycle device can additionally comprise a second supply apparatus for supplying a third mass flow of the preheated working medium to the evaporated and superheated first mass flow of the working medium prior to its expansion in the expansion machine. This allows for temperature limitations prior to direct injection into the expansion machine and a reduction in superheating, even if the real expansion ratio is not to be lowered (further). This strategy enables rapid control of the live steam temperature.

The second supply apparatus can comprise a second supply line arranged between the preheater or the first supply line, on the one hand, and the inlet or a third line arranged between the evaporator and the inlet, on the other hand.

The second supply apparatus can comprise a second actuatable throttle element, in particular a second thermostatic expansion valve, for controlling the third mass flow.

Another development is that the feed pump can be coupled to a drive train driven via the expansion machine; and where the cycle device further comprises a controllable recirculation apparatus for partially recirculating working fluid from a high pressure side of the feed pump to a low pressure side of the feed pump. Fluctuations and instabilities in the evaporation zone can thus be prevented.

The controllable recirculation apparatus can comprise a line from the high pressure side to the low pressure side of the feed pump, where the line can be provided with a third actuatable throttle element.

According to a further embodiment, a rotation of the expansion machine can be coupled with a rotation of an externally running process; where in particular a shaft of the expansion machine can be coupled to an external drive train of a motor, either directly or indirectly via a transmission.

The object according to the invention is further satisfied by a method according to claim 11.

The method according to the invention for operating a thermodynamic cycle, in particular an ORC process, comprises the following steps: preheating a working medium with a preheater; evaporating and superheating a first mass flow of the preheated working medium with an evaporator; expanding the evaporated and superheated first mass flow of the working medium in an expansion machine between an inlet and an outlet of the expansion machine; condensing the working medium exiting the outlet with a condenser; and pumping condensed working fluid to the preheater with a feed pump; the method being characterized by supplying a second mass flow of the preheated working medium to the partially expanded first mass flow of the working medium in the expansion machine.

The advantages of the method according to the invention and its developments correspond to those of the device according to the invention, unless stated otherwise.

According to one development of the method according to the invention, the following further step can be provided: controlling the second mass flow and/or injecting the second mass flow into an expansion space of the expansion machine.

A further development is that the method can further comprise: supplying a third mass flow of the preheated working medium to the evaporated and superheated first mass flow of the working medium prior to its expansion in the expansion machine.

According to another development, the third mass flow can be controlled.

Another development is that the following further step can be provided: coupling a rotation of the expansion machine with a rotation of an externally running process; in particular by coupling a shaft of the expansion machine to an external drive train of a motor, either directly or indirectly via a transmission.

The developments mentioned can be used individually or as claimed suitably in combination with each other.

Further features and exemplary embodiments as well as advantages of the present invention are illustrated below using the figures. It is understood that the embodiments do not exhaust the scope of the present invention. It is further understood that some or all features described hereafter can also be combined with each other in different ways.

DETAILED DESCRIPTION OF THE INVENTION

Figure 1:
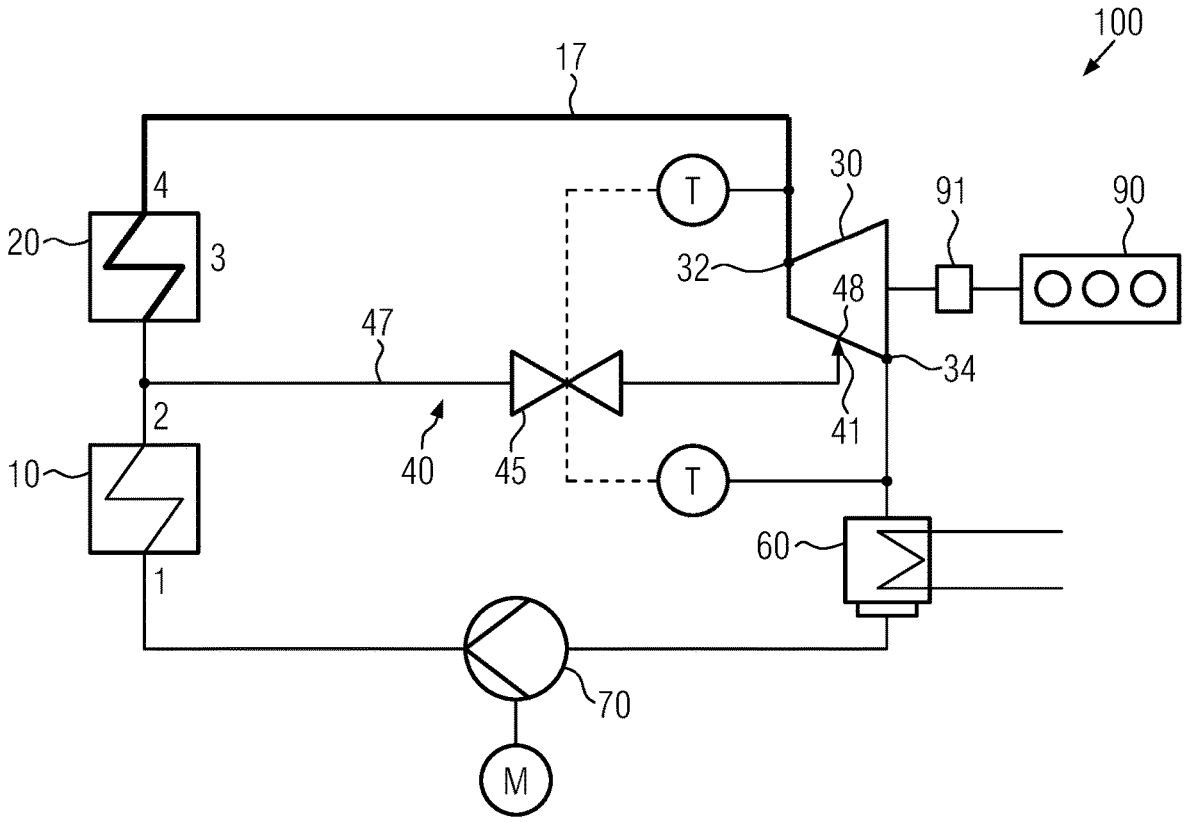
FIG. 1 shows a first embodiment of the thermodynamic cycle device according to the invention.

FIG. 1 shows a first embodiment of thermodynamic cycle device 100 according to the invention in the form of an ORC device (Organic Rankine Cycle). The cycle device comprises a preheater 10 for preheating a working medium; an evaporator 20 for evaporating and superheating a first mass flow of the preheated working medium; an expansion machine 30 for expanding the evaporated and superheated first mass flow of the working medium; a condenser 60 for condensing the working medium exiting the expansion machine 30; and a feed pump 70 (with motor M) for pumping condensed working medium to preheater 10. According to the invention, a first supply apparatus 40 is proved for supplying a second mass flow of the preheated working medium to the partially expanded first mass flow of the working medium in expansion machine 30.

First supply apparatus 40 comprises a supply inlet 48 of expansion machine 30 and a first supply line 47 between preheater 10 and supply inlet 48. Supply inlet 48 is disposed in fluid communication with an expansion space of expansion machine 30 at a predetermined volume range of the expansion space, where the expansion space expands between an inlet 32 and an outlet 34 of expansion machine 30.

First supply apparatus 40 further comprises a first actuatable throttle element 45, in particular a first thermostatic expansion valve, for controlling the second mass flow and/or where first supply apparatus 40 an injection device 41 at expansion machine 30, in particular at supply inlet 48.

The control can be effected on the basis of temperatures T measured and illustrated by way of example. In particular, throttle element 45 can be actuated accordingly.

The rotation of expansion machine 30 can be coupled with a rotation of an externally running process; where, in particular, a shaft 31 of expansion machine 30 can be coupled to an external drive train of a motor 90, either directly or indirectly via a transmission 91, which can have freewheeling or shifting options.

Injection of the preheated working medium into the already partially performed expansion has the effect illustrated below.

I. Providing Direct Injection of Preheated Fluid into the Ongoing Expansion According to the Process Control in FIG. 1, Thereby Satisfying Objects 1 and 2:

During the processes common to the ORC circuit of preheating VW ($\overline{Q}_{VW}$), evaporating VD ($\overline{Q}_{VD}$) and superheating ÜH ($\overline{Q}_{ÜH}$), part of the fluid ($\dot{m}_{AM,DE}$) is removed prior to evaporation. The total energy input into the system, which can be effected directly or via an intermediate circuit, can be determined as follows:

$$\dot{Q}_{ges}=\dot{Q}_{VW}+\dot{Q}_{VD}+\dot{Q}_{ÜH}$$

$$\dot{Q}_{VW}=(h_2-h_1)*\dot{m}_{AM,VW}=(T_2-T_1)*\dot{c}_{p,1\text{-}2}*\dot{m}_{AM,VW}$$

$$\dot{Q}_{VD}=(h_2-h_2)*\dot{m}_{AM,VD}=\Delta h_{evap}*\dot{m}_{AM,VD}$$

$$\dot{Q}_{ÜH}=(h_4-h_2)*\dot{m}_{AM,ÜH}=(T_4-T_2)*\dot{c}_{p,3\text{-}4}*\dot{m}m_{AM,ÜH}$$

$h_1$, $h_2$, $h_3$ and $h_4$ there denote the enthalpies at the respective positions indicated in FIG. 1. For the consideration presently used of diverting working medium (AM) after preheating, no further division of the mass flow is considered and the evaporation and superheating can be combined as evaporation with superheating ($\dot{Q}_{VÜ}$):

$$\dot{Q}_{VÜ}=\dot{Q}_{VD}+\dot{Q}_{ÜH}=(h_4-h_2)*\dot{m}_{AM,VÜ}$$

with $$\dot{m}_{AM,VÜ}=\dot{m}_{AM,VD}=\dot{m}_{AM,ÜH}$$

it is further true that: $\dot{m}m_{AM,VW}-\dot{m}_{AM,VÜ}=\dot{m}_{AM,DE}$

In order to again enable the degrees of freedom of temperature and the adapted expansion ratio, the diverted liquid working medium of the expansion machine is supplied via a suitable supply and injected directly already after a certain proportion of expansion (process control of FIG. 1). In order to obtain the fastest possible thermal equilibrium (heat input until a uniform temperature in the expansion chamber is given) for injection, the injection device must be configured accordingly and ensure good distribution with large fluid surfaces (e.g., fine atomization). For controllability of the parameters, a throttle element, in particular an actuatable or a passive throttle element (for example, a thermostatic expansion valve) is incorporated into the supply line.

An inlet bore must be made at a suitable location in the housing for the injection into the expander. It must be determined depending on the volume ratio of the expansion machine. The still high pressure of the chamber has a limiting effect in the direction of the beginning of expansion, as a result of which the entry of liquid fluid is impeded. In addition, superheating can also increase in the course of the expansion, so that more liquid fluid can also be evaporated at a later time of the expansion. On the other hand, sufficient time should be allowed until the chamber is opened in order to obtain a thermal equilibrium with complete evaporation. Furthermore, participation in a large expansion proportion in the overall expansion is also positive for generating power.

This can achieve various positive effects:

a. Volume Ratio Adaptation

The volume ratio of the expansion ($^{\Phi}$EX) can be reduced dynamically (see also FIG. 5), the following relationship applies with the specific volumes at the time of chamber closure at the entry into the expansion machine ($^{v}$K, sin) and at the moment the chamber is opened at the outlet of the expansion machine ($^{v}$K,aus) with the fixed volume ratio of the expansion machine $V_i$:

$$\Phi_{EX}=\frac{v_{K,aux}}{v_{K,sin}}$$

$$v_{K,sin}=\frac{V_{K,sin}}{m_{AM,K,sin}}$$

$$v_{K,aux}=\frac{V_{K,aux}}{m_{AM,K,aux}}$$

$$V_i=\frac{V_{K,aux}}{V_{K,sin}}=konstant$$

with the chamber volumes at the inlet and outlet $$V_{K,\frac{sin}{aux}}$$

as well as the mass of the working medium enclosed in the chamber $$m_{AM,K,\frac{sin}{aux}}.$$

Since, in the standard case without chamber injection, the mass of the working medium in the chamber is constant, it arises that $^{\Phi}EX=V_i$ The real expansion ratio ($^{\Phi}$real) prevailing is determined from the live steam parameters as well as the exhaust steam parameters and is determined by the pressure and the temperature upstream and downstream of the expansion machine.

The case of $^{\Phi}$real<, $^{\Phi}$EX exists in the region of post compression. There, the fluid during the expansion in the expansion machine (chamber closed) is taken to a pressure level that is lower than actually existing downstream of the expansion machine. This leads to the fluid being compacted after the chamber has been opened, which has a very negative effect on the efficiency due to the increased expulsion work to be done by the expansion machine. In the region of post expansion ($^{\Phi}$real>$^{\Phi}$EX), the increased outlet pressure from the chamber has a positive effect. The pressure level in the expansion chamber is there at the end of the expansion still higher than that downstream of the expansion machine. As a result, the fluid expands even more when the chamber is opened, the post expansion generates additional power due to the lower expulsion work to be done by the expansion machine.

By injecting fluid during expansion, it is true that: $m_{AM,K,aus}>m_{AM,K,\ sin}$ which, according to the relationship illustrated above, results in a reduction of $^{\Phi}$EX, so that $^{\Phi}EX<V_i$:

$$\Phi_{EX} = \frac{v_{K,aux}}{V_{K,sin}} = \frac{V_{K,aux}}{m_{AM,K,aux}} * \frac{m_{AM,K,sin}}{V_{K,sin}} = \frac{V_{K,aux}}{V_{K,sin}} * \frac{m_{AM,K,sin}}{m_{AM,K,aux}} = V_l * \frac{m_{AM,K,sin}}{m_{AM,K,aux}} < V_1$$

Figure 4:
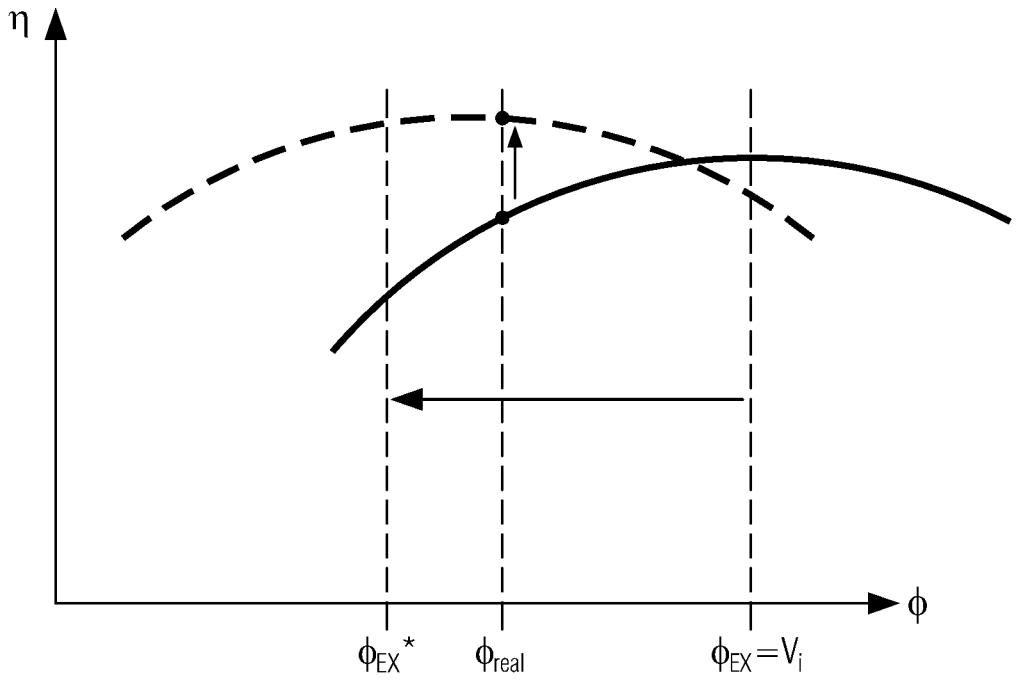
FIG. 4 qualitatively shows the relationship between the expansion ratio and expansion efficiency.

This shift is shown in FIG. 4 with the qualitative curve of the isentropic expansion efficiency.

Figure 5:
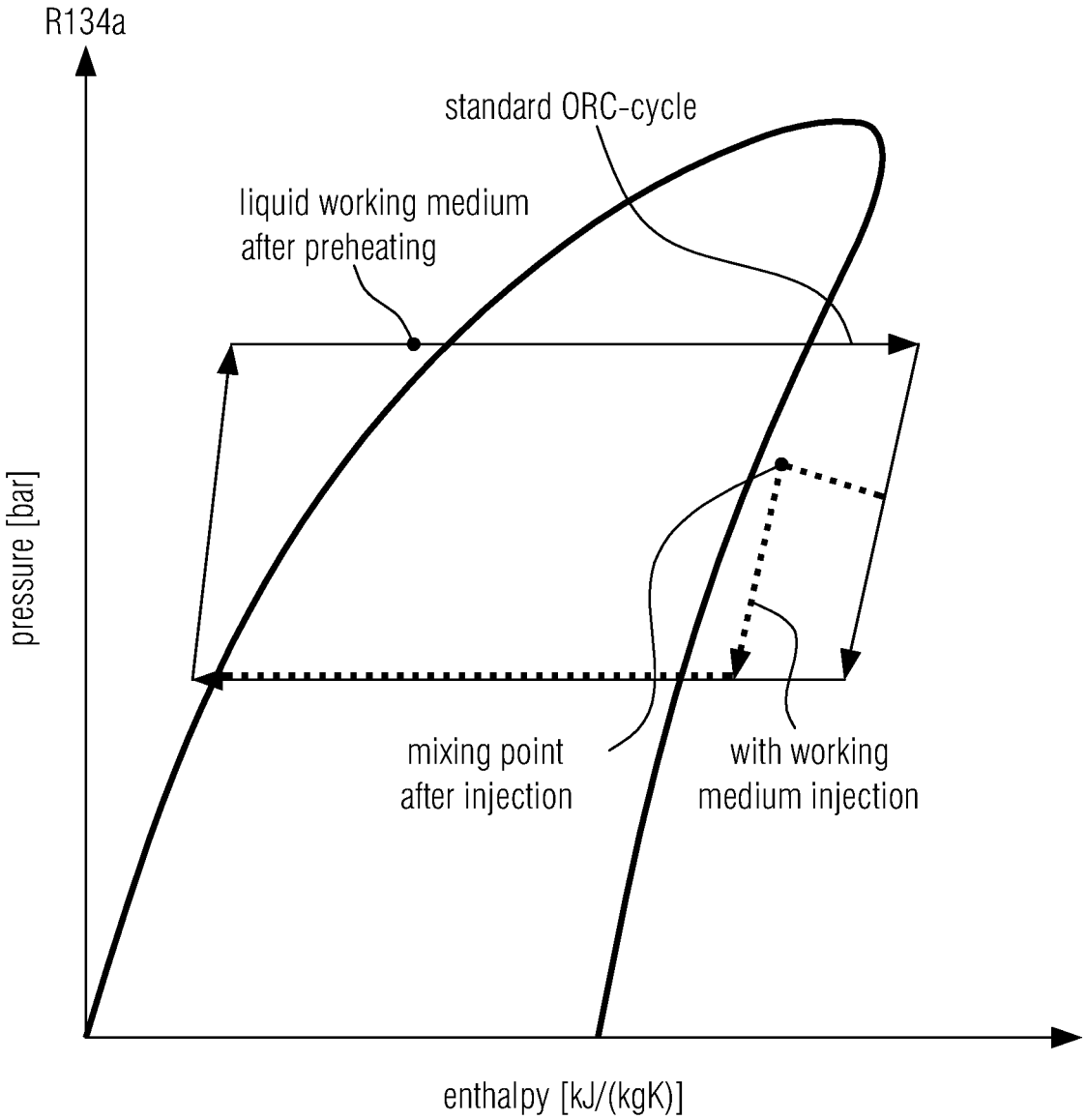
FIG. 5 is an exemplary representation of the relationship between the pressure and the enthalpy for direct injection of preheated working fluid into the expansion machine.

Furthermore, the principle of internal recuperation (as shown in FIG. 5) is thereby integrated into the process.

This leads to an improvement in the power output of the system in two ways. On the one hand, superheating of the dry fluid increasing with expansion is used to vaporize additional preheated AM for the expansion and thus to increase the mass flow of the AM participating in the expansion. The energy of the superheating of the exhaust steam would otherwise have to be dissipated via the condenser. In addition, the low temperature heat source of the preheater is usually not fully utilized and can be better utilized by the increased amount of fluid in the preheating.

The internal recuperation there avoids two problems which a normal recuperation has subsequent to the expansion. Firstly, no additional pressure loss arises due to installations after expansion which reduces the pressure level available for expansion. Furthermore, a subsequent recuperation corresponds to a preheating of the AM, for which, however, sufficient heat at a low temperature level is usually already available, for which reason it reduces the amount of heat used compared to that which is available.

b. Reducing Superheating of the Exhaust Steam

In addition to the positive effect on performance, it can also be necessary, due to the limitation of the components, e.g. of the steam-cooled generator, to reduce the evaporation temperature. An increase in the mass flow would reduce superheating of the AM but can not influence the fluid already present as live steam and therefore represents relatively sluggish control intervention. On the other hand, this can be realized very quickly with the injection.

Since the total heat balance is not affected by the bypass, readjustment via the mass flow is necessary also with this rapid control of the live steam temperature. This is done by rotational speed control of the pump (non-variable speed pumps shall be discussed in section III in the context of FIG. 3).

Temperature limitations of components that are upstream of the direct injection into the ongoing expansion can not be ensured thereby (see section II).

c. Measuring the Parameters

Two control strategies are conceivable for this:

1. Upstream of the injection point: Model-predictive determination of the quantity of AM to be injected based on a measured actual value. It is not measured to what extent the required setpoint value (=maximum value) also sets after injection.
2. Downstream of the injection point: "conventional" control of the quantity of AM to be injected by comparison of setpoint to actual value.

Figure 2:
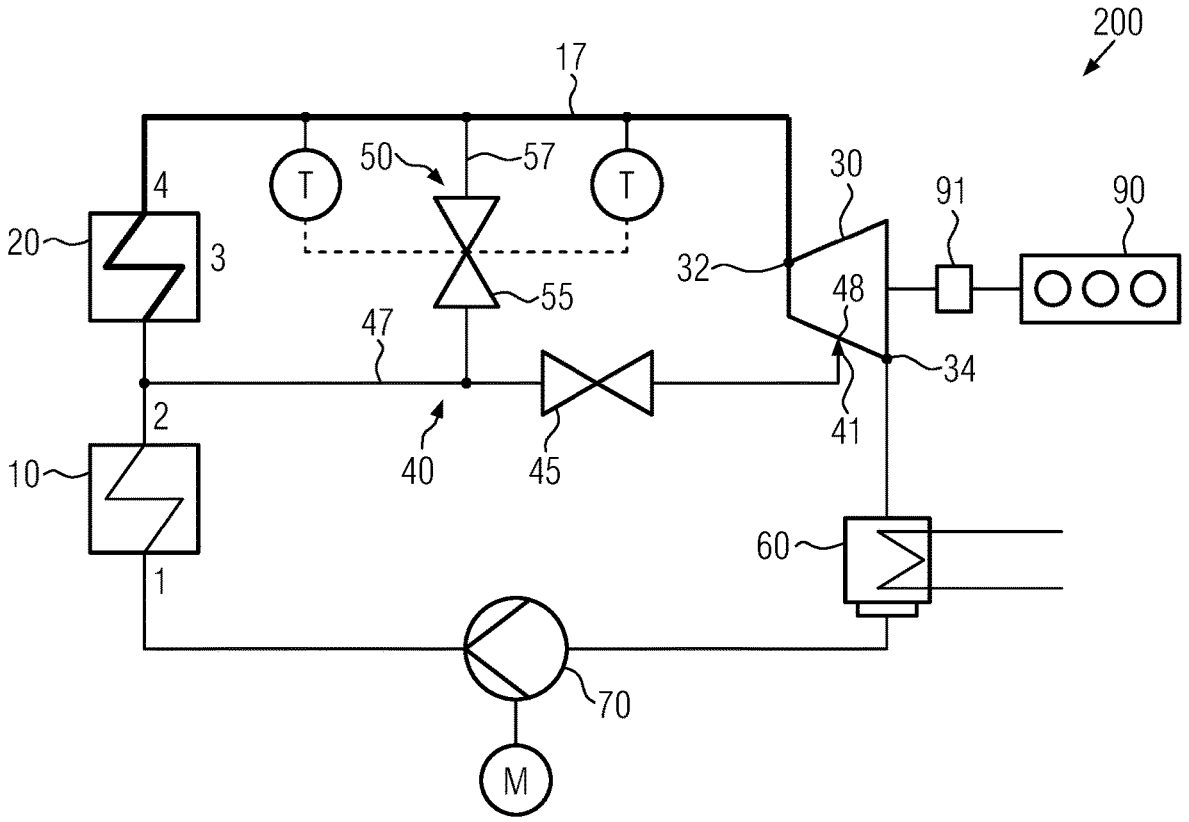
FIG. 2 shows a second embodiment of the thermodynamic cycle device according to the invention.

FIG. 2 shows a second embodiment of thermodynamic cycle device 200 according to the invention which has further features over with the first embodiment. The same reference numerals denote the same elements. A second supply apparatus 50 is provided for supplying a third mass flow of the preheated working medium to the evaporated and superheated first mass flow of the working medium prior to its expansion in expansion machine 30. Second supply apparatus 50 comprises a second supply line 57 which is arranged between preheater 10 or first supply line 47, on the one hand, and inlet 32 or a third line 17 arranged between evaporator 20 and inlet 32, on the other hand, where second supply apparatus 50 comprises a second actuatable throttle element 55, in particular a second thermostatic expansion valve, for controlling the third mass flow.

This measure has the effect described below.

II. Providing Direct Injection of Preheated Fluid Prior to the Expansion, as Shown in FIG. 2, to Satisfy the Remainder of Object 1 (Temperature Limitation Prior to the Expansion):

a. Reducing Superheating of the Live Steam

In addition to the direct injection into the expansion machine (process control according to FIG. 1), direct injection of preheated fluid into the live steam upstream of the expansion machine can be necessary—for example, if also the temperature limitations prior to direct injection into the expansion machine are not otherwise ensured (process control according to FIG. 2) or if reducing the superheating is necessary, but the real expansion ratio (by process control of FIG. 1) is not to be lowered (further).

This strategy enables rapid control of the live steam temperature which would be too slow via the pump, as already described.

However, since the overall heat balance is retained by this measure, control of the total mass flow must also be effected, for example, by increasing the pump capacity.

b. Measuring the Parameters

Two control strategies are conceivable for this:

1. Upstream of the injection point: Model-predictive determination of the quantity of AM to be injected based on a measured actual value It is not measured to what extent the required setpoint value (=maximum value) also sets after injection.
2. Downstream of the injection point: "conventional" control of the quantity of AM to be injected by comparison of setpoint and actual value.

Figure 3:
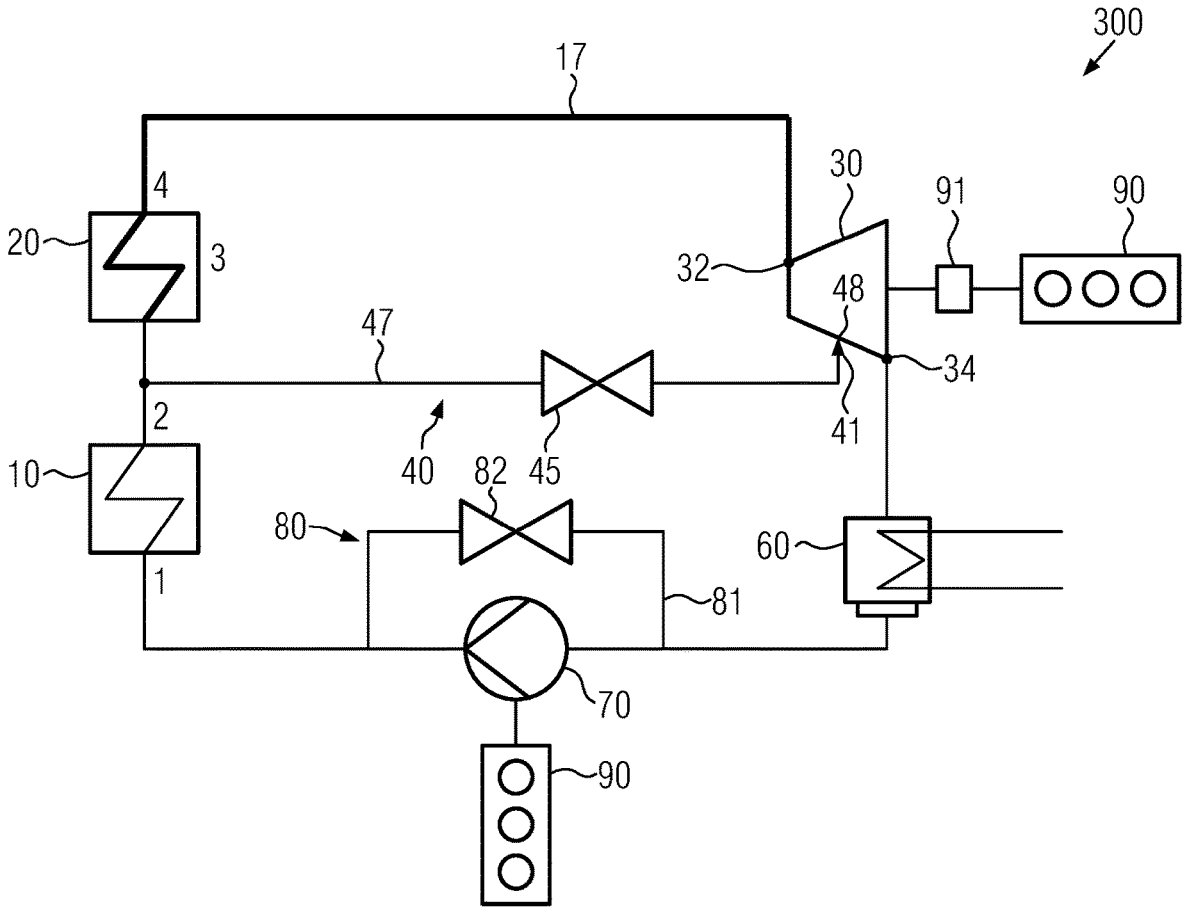
FIG. 3 shows a third embodiment of the thermodynamic cycle device according to the invention.

FIG. 3 shows a third embodiment of thermodynamic cycle device 300 according to the invention. Feed pump 70 is coupled to a drive train driven via expansion machine 30, namely to external motor 90; where the cycle device further comprises a controllable recirculation apparatus 80 for partially recirculating working fluid from a high pressure side of feed pump 70 to a low pressure side of feed pump 70. Controllable recirculation apparatus 80 comprises a line 81 from the high pressure side to the low pressure side of feed pump 70, where line 81 is provided with a third actuatable throttle element 82.

This measure has the effect described below.

III. Providing a Controllable Recirculation Around the Feed Pump in the Case of an Additional Coupling of the Feed Pump with the External Process According to FIG. 3 for Satisfying the Above-Mentioned Objects 3 and 4:

In the event that the pump is also firmly coupled with the process, a configuration of the pump with a recirculation circuit is necessary (process control according to FIG. 3).

The disadvantage of this circuitry is that additional losses are created by the recirculation around the pump. However, this is necessary in order to maintain control of the mass flow with a fixed connection.

In this case, the pump is to be dimensioned such that the least possible losses occur in a full load case and at the same time sufficient control power is available at a partial load. Control power is necessary both for increasing the mass flow through the ORC circuit (e.g. when superheating is too high) and for reducing the mass flow (e.g. quantity of heat available is smaller than the quantity of heat dissipated by AM or the actual steam pressure arising is above the evaporation pressure at the temperature level available).

Furthermore, the division into a two-component control, in which the first bypasses the evaporator (bypass branches off upstream of VD and recirculates the fluid downstream of VD+ÜH), and the second, which comprises readjusting the mass flow (either via the pump with variable speed motor or via a recirculation control) by the evaporator, entails the advantage that sudden fluctuations and instabilities in the evaporation zone are avoided. This influence is briefly explained by the example of excessive superheating with the necessity of increasing the mass flow:

The control of the pump/recirculation increases the mass flow, at the same time the direct injection is increased. As a result, the flow through the evaporator and the superheater experiences only a small change in mass flow. As the various heat transfers in the evaporator/superheater react sensitively to level changes, this measure helps to stabilize the process. In the event that only or also the process control according to FIG. 2 is employed, their proportion of $\dot{m}_{AM,DE}$ is slowly again reduced to zero, so that overall a more rapid control intervention with rel. slow rates of change in the flow through the evaporator is obtained.

The embodiments illustrated are only by way of example and the full scope of the present invention is defined by the claims.

The invention claimed is:

1. A thermodynamic Organic Rankine Cycle (ORC) device, comprising:

a preheater for preheating a working medium;

an evaporator for further preheating, evaporating and superheating a first mass flow of the preheated working medium; and a volumetric expansion machine for expanding the evaporated and superheated first mass flow of the working medium;

a condenser for condensing the working medium exiting said volumetric expansion machine;

a feed pump for pumping condensed working medium to said preheater; and a first supply apparatus for supplying a second mass flow of the preheated working medium to the partially expanded first mass flow of the working medium in an expansion chamber of said volumetric expansion machine, wherein the second mass flow is supplied to the expansion chamber during a time period in which there is no first mass flow into or out of the expansion chamber.

2. The thermodynamic cycle device according to claim 1, wherein said first supply apparatus comprises a supply inlet of said volumetric expansion machine and a first supply line between said preheater and said supply inlet, wherein said first supply apparatus comprises an injection device at said supply line of said volumetric expansion machine.

3. The thermodynamic cycle device according to claim 2, wherein said supply inlet is disposed in fluid communication with an expansion space of said volumetric expansion machine at a predetermined volume range of said expansion space, and wherein said expansion space expands between an inlet and an outlet of said volumetric expansion machine.

4. The thermodynamic device according to claim 1, wherein said first supply apparatus comprises a first throttle element for controlling the second mass flow.

5. The thermodynamic cycle device according to claim 1, further comprising:

a second supply apparatus for supplying a third mass flow of the preheated working medium to the evaporated and superheated first mass flow of the working medium prior to its expansion in said volumetric expansion machine.

6. The thermodynamic device according to claim 2, further comprising:

a second supply apparatus for supplying a third mass flow of the preheated working medium to the evaporated and superheated first mass flow of the working medium prior to expansion of the third mass flow in said volumetric expansion machine, wherein said second supply apparatus comprises a second supply line arranged between said preheater or said first supply line, on the one hand, and said supply inlet or a third line arranged between said evaporator and said supply inlet, on the other hand.

7. The thermodynamic cycle device according to claim 5, wherein said second supply apparatus comprises a second throttle element for controlling the third mass flow.

8. The thermodynamic cycle device according to claim 1, wherein said feed pump is coupled to a drive train driven via said volumetric expansion machine, and wherein said cycle device further comprises:

a controllable recirculation apparatus for partially recirculating working fluid from a high pressure side of said feed pump to a low pressure side of said feed pump.

9. The thermodynamic cycle device according to claim 8, wherein said controllable recirculation apparatus comprises a line from the high pressure side to the low pressure side of said feed pump, and wherein said line is provided with a third throttle element.

10. The thermodynamic cycle device according to claim 1, wherein a rotation of said volumetric expansion machine can be coupled with a rotation of an externally running process, wherein a shaft of said volumetric expansion machine can be coupled to an external drive train of a motor, either directly or indirectly, via a transmission which has freewheeling or shifting options.

11. A method for operating a thermodynamic Organic Rankine Cycle (ORC) process, said method comprises the following steps:

preheating a working medium with a preheater;

further preheating, evaporating and superheating a first mass flow of the preheated working medium with an evaporator;

expanding the evaporated and superheated first mass flow of the working medium in a volumetric expansion machine;

condensing the working medium exiting said volumetric expansion machine with a condenser;

pumping condensed working medium to said preheater with a feed pump; and supplying a second mass flow of the preheated working medium to the partially expanded first mass flow of the working medium in an expansion chamber of said volumetric expansion machine, wherein the second mass flow is supplied to the expansion chamber during a time period in which there is no first mass flow into or out of the expansion chamber.

12. The method according to claim 11, comprising the further step of:

controlling the second mass flow and/or injecting the second mass flow into an expansion space of said volumetric expansion machine between an inlet and an outlet of said volumetric expansion machine.

13. The method according to claim 11, further comprising:

supplying a third mass flow of the preheated working medium to the evaporated and superheated first mass flow of the working medium prior to expansion in said volumetric expansion machine; and controlling the third mass flow.

14. The method according to claim 13, comprising the further step of:

reducing a volume ratio of the expansion of the working medium expanded in the volumetric expansion machine by supplying the second mass flow of the preheated working medium in the expansion chamber.

15. The method according to claim 11, comprising:

coupling a rotation of said volumetric expansion machine with a rotation of an externally running process by coupling a shaft of said volumetric expansion machine to an external drive train of a motor, either directly or indirectly via a transmission.

16. The thermodynamic cycle device according to claim 2, wherein said first supply apparatus comprises a first throttle element for controlling the second mass flow and/or wherein said first supply apparatus comprises an injection device at said volumetric expansion machine.

17. The thermodynamic cycle device according to claim 2, further comprising:

a second supply apparatus for supplying a third mass flow of the preheated working medium to the evaporated and superheated first mass flow of the working medium prior to its expansion in said volumetric expansion machine.

18. The thermodynamic cycle device according to claim 4, further comprising:

a second supply apparatus for supplying a third mass flow of the preheated working medium to the evaporated and superheated first mass flow of the working medium prior to its expansion in said volumetric expansion machine.

19. The thermodynamic cycle device according to claim 6, wherein said second supply apparatus comprises a second throttle element for controlling the third mass flow.

20. The thermodynamic cycle device according to claim 2, wherein said feed pump is coupled to a drive train driven via said volumetric expansion machine, and wherein said cycle device further comprises:

a controllable recirculation apparatus for partially recirculating working fluid from a high pressure side of said feed pump to a low pressure side of said feed pump.

* * * * *